US006033088A

United States Patent [19]

Contigiani

[11] Patent Number: 6,033,088

[45] Date of Patent: Mar. 7, 2000

[54] DECORATIVE LIGHTING SYSTEMS

[76] Inventor: Frank Contigiani, 2020 Mac Larie La., Broomall, Pa. 19008

[21] Appl. No.: 08/880,904

[22] Filed: Jun. 23, 1997

[51] Int. Cl.[7] ..... F21V 21/00

[52] U.S. Cl. ..... 362/249; 362/252; 362/806

[58] Field of Search ..... 362/249, 219, 362/252, 225, 806

[56] References Cited

U.S. PATENT DOCUMENTS

| | | | |
|---|---|---|---|
| 3,204,090 | 8/1965 | Kvarda, Jr. | 362/249 |
| 3,692,993 | 9/1972 | Robinson | 362/249 |
| 5,031,083 | 7/1991 | Claesson | 362/249 |
| 5,113,329 | 5/1992 | Lin | 362/238 |
| 5,609,412 | 3/1997 | Contigiani | 362/249 |

*Primary Examiner*—Thomas M. Sember
*Attorney, Agent, or Firm*—Woodcock Washburn Kurtz Mackiewicz & Norris LLP

[57] ABSTRACT

A lighting assembly for receiving a string of lights having light bulbs held in a socket and used as a decorating ornament is provided. The lighting assembly comprises at least one perforated member for supporting a string of lights. The perforated member defining a plurality of openings which are adapted to receive at least one light bulb supported on the string of lights. At least one support member for supporting the string of lights within the perforated member in an operating position is provided. The support member is coupled with the perforated member.

17 Claims, 4 Drawing Sheets

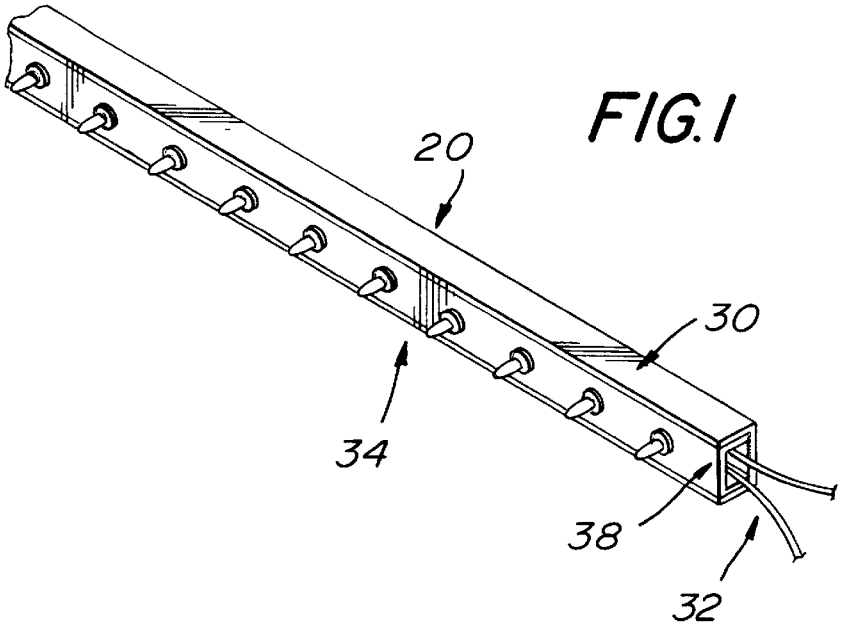
FIG. 1
FIG. 2
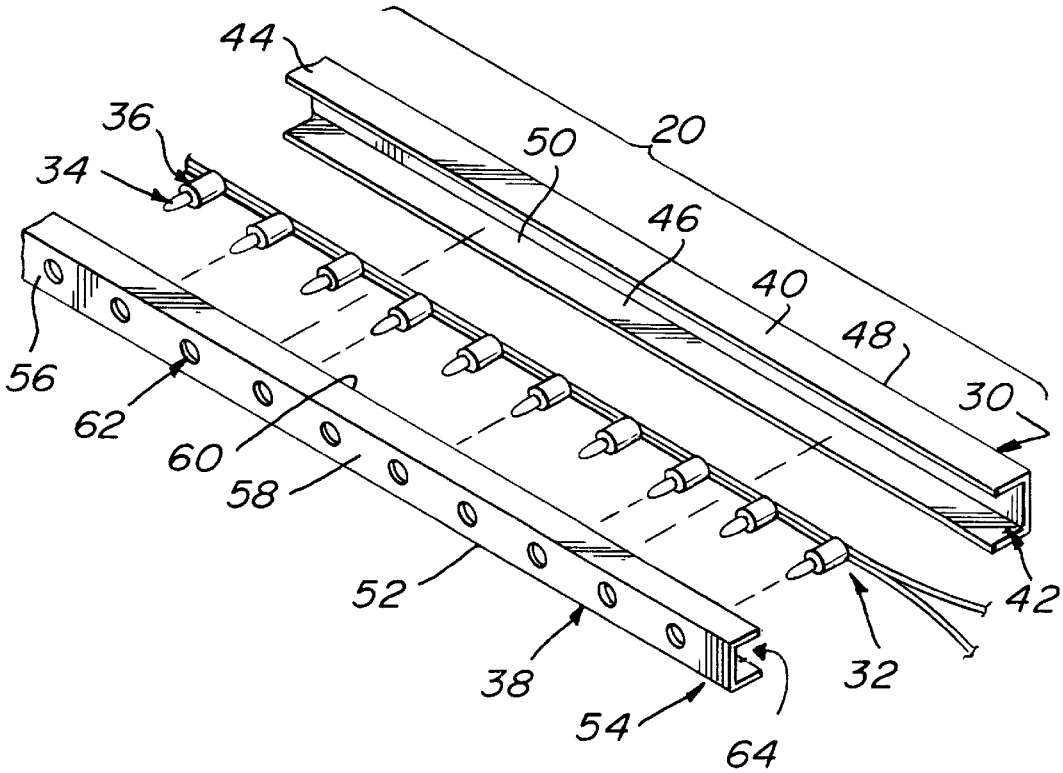

FIG. 4
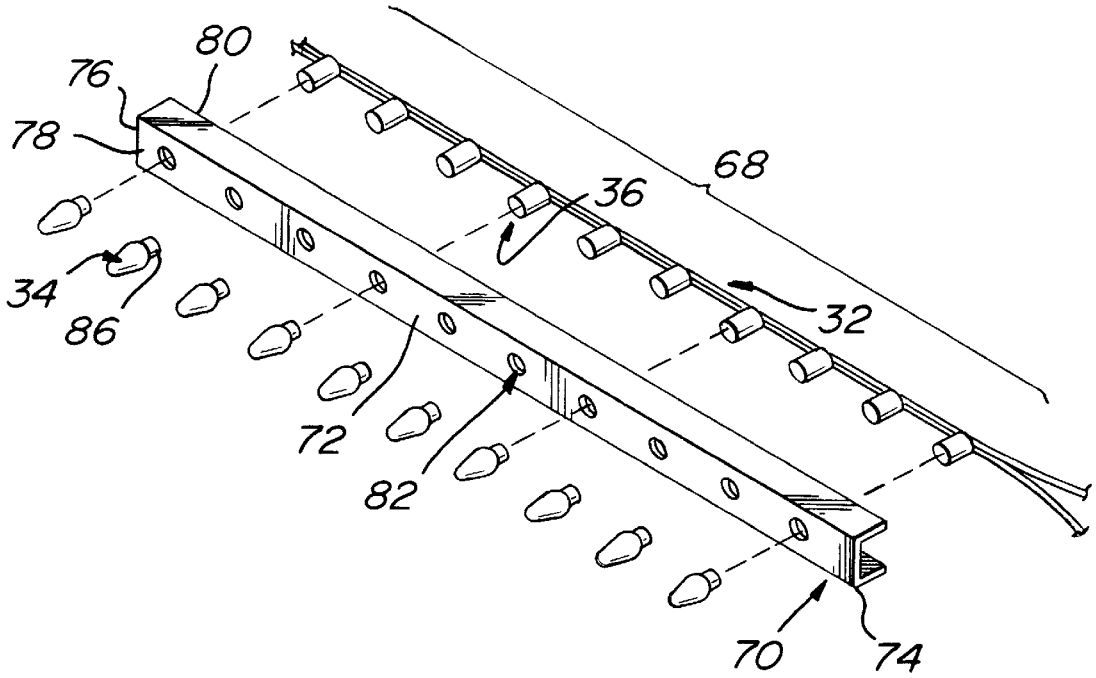
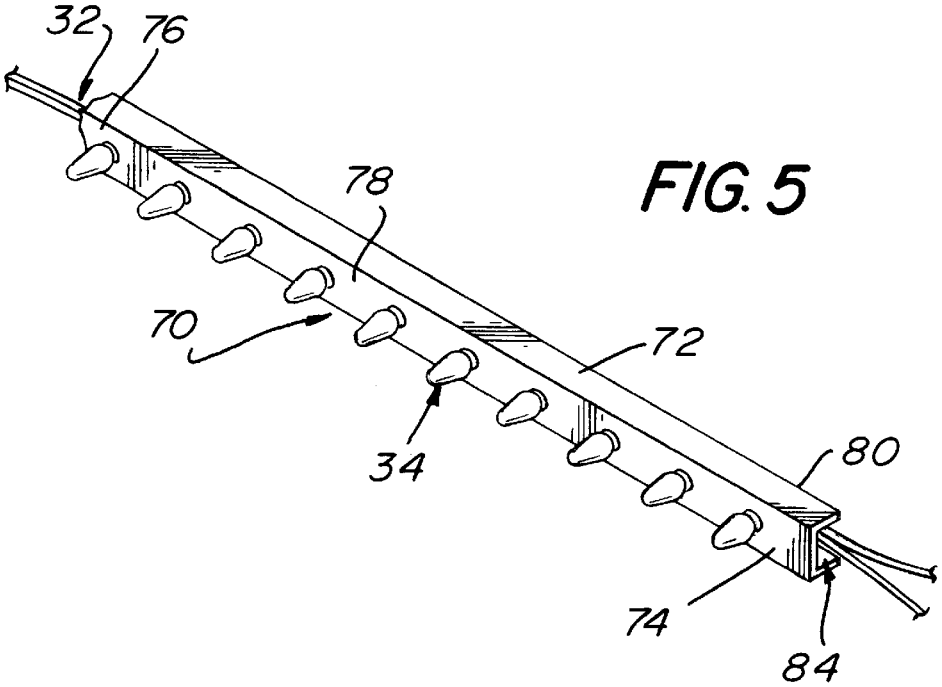
FIG. 5

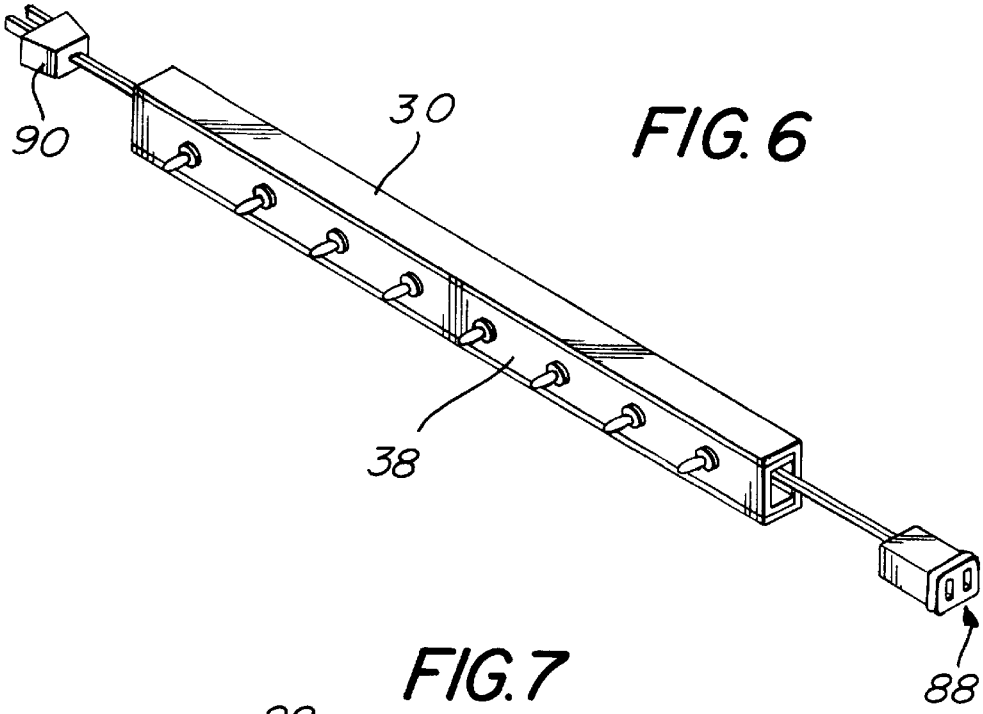
FIG. 6
FIG. 7
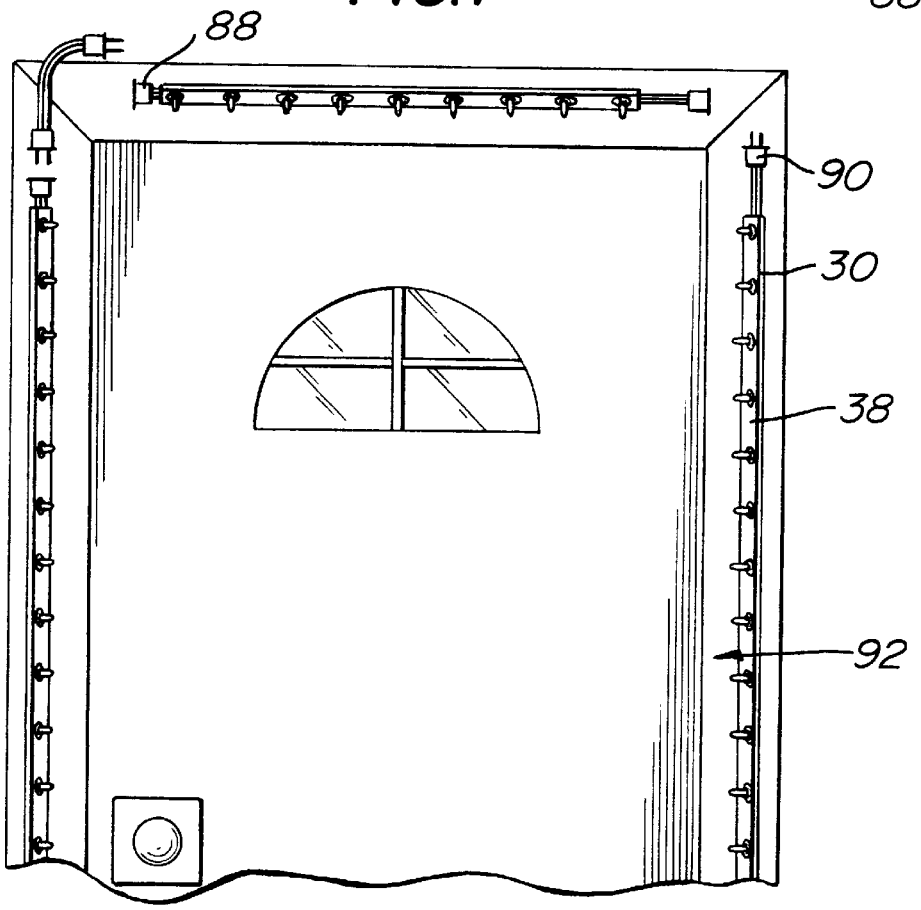

DECORATIVE LIGHTING SYSTEMS

FIELD OF THE INVENTION

This invention relates generally to decorative lights, and more particularly to a string of decorative lights that can be stored without damaging the bulbs and without forming tangles along the length of the string of lights.

BACKGROUND OF THE INVENTION

In celebration of holidays, birthdays and other parties, it is common for people to decorate their home, office, and other locations. In celebrating these occasions, a substantial number of people happily decorate their homes. Commonly, in preparation for such celebrations people dress windows, doorways, walls, and other surfaces with decorative bulbs, tinsel, garland, a string of lights, and other ornaments.

It is highly probable, however, that any excitement during this time will be diminished because of a set of tangled up string of decorating lights.

After the string of decorative lights is removed from storage, these lights generally can not be immediately placed because they are tangled or knotted. It is therefore an objective of the inventor to provide a string of lights that can be immediately placed after being removed from storage.

Some people become so frustrated because of all of the tangles and knots in the old string of lights that they throw the old lights away and then purchase new strings of lights. It is therefore an objective of the inventor to provide a set of string of lights that is reusable.

If the old string of lights is not thrown away, a person may notice that, after untangling the string of lights, it is difficult to place the lights evenly around or on the desired surface. It is therefore another objective of the inventor to provide a string of lights that can be placed relatively evenly proximate an area that is to be decorated.

In prior art, after the string of lights is placed in the desired location, it is highly likely that at least one of the light bulbs has been broken during storage. The light bulbs can easily be broken because the lights can not be stored safely. It is therefore, another objective of the inventor to provide a string of lights that can be safely stored.

U.S. Pat. No. 5,609,412 is related to similar subject matter and overcomes these problems. The present invention is a variation of U.S. Pat. No. 5,609,412 and is hereby incorporated by reference in its entirety.

Additional objectives of the inventor and advantages of the invention will be set forth in part in the description which follows, and in part will be obvious from the description, or may be learned by practice on the invention. The objectives of the inventor and advantages of the invention may be realized and attained by means of the instrumentalities and combinations particularly pointed out in the appended claims.

SUMMARY OF THE INVENTION

A lighting assembly for receiving a string of lights having light bulbs held in a socket and used as a decorating ornament is provided. The lighting assembly comprises at least one perforated member for supporting a string of lights. The perforated member defines a plurality of openings which are adapted to receive at least one light bulb supported on the string of lights. At least one support member for supporting the string of lights within the perforated member in an operating position is provided. The support member is coupled with the perforated member.

BRIEF DESCRIPTION OF THE DRAWINGS

The accompanying drawings which are incorporated in and constitute a part of the specification, illustrate at least one embodiment of the invention and together with the description, serve to explain the principles of the invention.

The invention will now be further described by way of example, with reference to the accompanying drawings, in which:

FIG. 1 is perspective view of the preferred embodiment in of the present invention;

FIG. 2 is an exploded view of the embodiment shown in FIG. 1;

FIG. 4 is a perspective view of another embodiment in accordance with the present invention;

FIG. 5 is an exploded view of the embodiment shown in FIG. 4;

FIG. 6 is a perspective view of another embodiment in accordance with the present invention; and FIG. 7 is a perspective view of the embodiment in FIG. 6 in operation.

DETAILED DESCRIPTION OF THE PREFERRED EMBODIMENT

Figure 3:
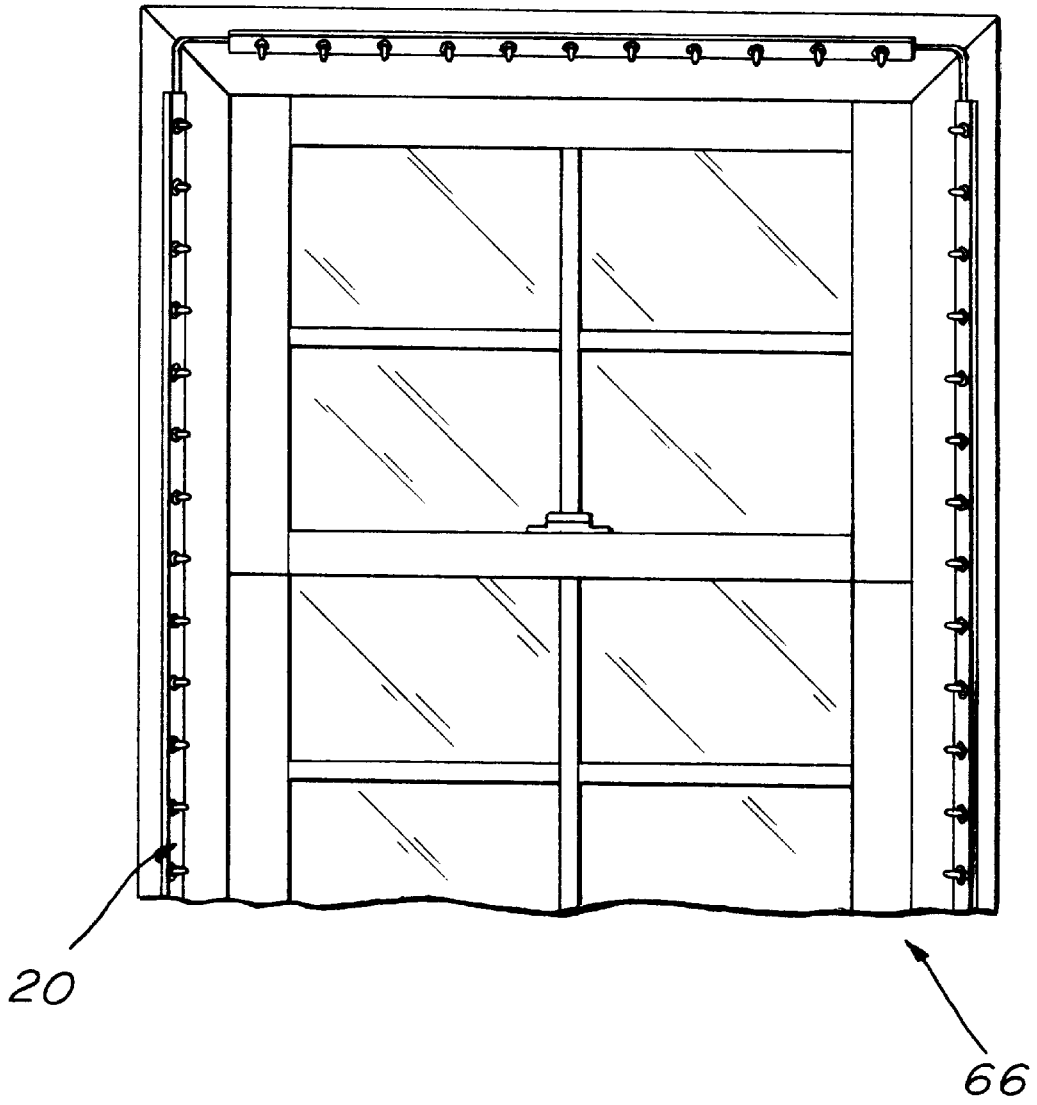
FIG. 3 shows the embodiment in FIG. 1 in operation.

Reference will now be made in detail to the present preferred embodiment of the invention, an example of which is illustrated in the accompanying drawings. It is noted that like materials or parts are designated by the same numeral throughout the drawings.

The preferred embodiment of the lighting assembly for decorating an area is shown in FIG. 1 and represented generally by the numeral 20. The lighting assembly 20 comprises at least one support member 30 for receiving a string of electric lights 32 having a plurality of decorative light bulbs 34 held within sockets 36 and an electric socket plug. At least one perforated member 38 is provided to maintain the string of lights 32 within the support member 30.

FIG. 2 is an exploded view showing the preferred embodiment of the lighting assembly 20. The support member 30 comprises an elongated body 40 that has a first end 42, an opposing second end 44, a relative inner portion 46 and a relative outer portion 48 which define at least one channel 50. The channel 50 is formed proximate the relative inner portion 46 and extends between the first end 42 and second end 44 of the support member 30 and is adapted to receive most commercially available strings of decorative lights 32. Preferably, the support member 30 comprises three solid relatively straight elongated sides cooperating at right angles with one another to form the channel 50. At least one of the sides may be adapted to have an adhesive on velcro layer that can attach to a surface such as a wall or door panel. Other types of fastening members may also be employed. It is noted that the support member may be generally flat without a channel so long as the support member and perforated member can maintain the decorative lights in an operating position.

Preferably, the perforated member 38 is a separate component that has an elongated body 52 which has a first end 54, opposing second end 56, a relative outer surface 58, and a relative inner surface 60. The elongated body defines a plurality of openings 62 that are adapted to receive and support a decorative light bulb. The openings 62 are spaced along the elongated body according to the spacing of light bulbs on commercially available decorative strings of lights.

The inner surface 60 of the perforated member is adapted to removably attach to the support member 30. Preferably, the inner surface 60 of the perforated member 38 is formed with a flange end 64 that is adapted to removably snap fit with the support member 30. It is noted that the support member 30 and perforated member 38 can be formed in many shapes and sizes. The support member 30 and the perforated member 38 can be made from any plastic like material, such as PVC and polyethylene. Both the support member 30 and perforated member 38 can also be formed such that they may be cut to fit into relatively difficult areas.

Alternatively, the perforated member 38 may be integrally formed with the support member or otherwise movably coupled with the support member. The perforated member may be coupled with the support member with a tether or other hinge like member. The perforated member and support member may be formed with a latching means. One means for latching may include a slot formed in either or both the perforated member and support member. A latch is formed or otherwise provided on one of the members 38 and 30 which is adapted to engage a corresponding slot such that the perforated member and support member can be securely coupled together to support a string of lights. When the perforated member is integrally formed with the support member or otherwise removably coupled with the support member 30, the support member 30 must be able to move from a first position such that the light bulbs can be received within the openings in the perforated member 38, and then move to a second position such that the string of lights are securely supported therein.

The assembling of a completed lighting assembly consists of the support member 30 receiving a string of electric lights 32 within the channel 50. The perforated member 38 is positioned over the light bulbs such that the bulbs are placed through respective openings 62 formed in the perforated member 38. The perforated member 38 is then snap fit onto the support member body 40, thereby securing the string of lights therein.

Referring to FIG. 3, the decorative lighting assembly 20 is shown placed proximate a window 66. A plurality of support members 30 and perforated members 38 are assembled with one relatively long string of decorative lights 32. The string of lights 32 is placed within the support member channel 50 and secured therein with the bulbs extending from the opening 62 in the perforated member 38. An appropriate length or portion of the string of lights is left between an adjacent assembly such that another support member/perforated member can be manipulated along a surface to decorate the area proximate the lighting assembly. In this manner the bulbs 34 are supported by the support member and perforated member thereby allowing the light from the bulbs to shine outwardly from the decorated surface when the string of lights is plugged into an electrical socket and turned on. The support member 30 is attached to a surface by an adhesive, velcro or other fastening member. It is noted that the decorative lighting assembly may be employed indoors or outdoors.

Further, the support member 30 or perforated member 38 may have a color layer that is aesthetically pleasing or which permits each support member to blend in with the color of the decorated surface. For example, the support member can be colored with an appropriate pastel color that matches the color of window paint or treatment, or have a textured color to blend in with wood or marble applications.

An alternative embodiment of the present invention of the lighting assembly is shown in FIGS. 4 and 5 and is represented generally by the numeral 68. The electric lighting assembly 68 comprises at least one perforated support member 70 and a string of lights 32 having a plurality of light bulbs 34 held with sockets 36. The perforated support member 70 has an elongated body 72 having first end 74, second end 76, an outer surface 78 and an inner surface 80. A plurality of perforations 82 are formed and spaced about the elongated body and are adapted to supportingly receive a string of decorative lights 32. Each of the openings 82 is adapted to enable a light bulb to pass therethrough and be supportingly maintained without any other securing member. It is noted that the elongated body 72 can be relatively flat or comprise a channel 84 to maintain the string of lights and hide the string as shown in FIG. 5.

Preferably, the string of lights is supported by the perforated support member 70 by first unscrewing or otherwise removing all of the bulbs 34 from the socket 36. Next, the sockets 36 and string are positioned adjacent to the relative inner surface 80 of the perforated support member 70. The light bulbs 34 are positioned adjacent to the outer surface 78 of the perforated support member 70 such that the attaching end 86 of the light bulb is placed through the opening 82 and securely positioned back into the socket 36. In this position, the light bulbs 34 should be securely positioned through respective openings 82 in an operating position. An appropriate length or portion of the string of lights may be left between each perforated support member 70 such that the lighting assembly can be manipulated to decorate a desired area. This operation is continued until the entire string of lights is secured with each individual perforated support member.

It is noted that each perforated support member can be formed in many shapes and sizes. Preferably, the perforated support member 70 is made from a plastic like material, such as PVC and polyethylene can be manipulated to fit decorative surfaces with different widths and lengths.

One type of string of lights that is commercially available that can be employed with either the support member/perforated member 30, 38 or perforated support member 70 measures 45 feet long having a 100 decorative lights, therefore several support members 30 and perforated members 38 or several perforated support members 70 would be needed to hold the entire string of lights. The length of each member that the lights are placed in would vary in length as the lighting assembly is placed onto the desired surface. Longer members may be used to cover longer spans while shorter members may be used in smaller areas.

Alternatively, the string of lights can come in various ranges of lengths and sizes. Referring to FIG. 6, a string of lights of 48 inches long is shown with a corresponding perforated member 38 and support member 30. It is noted that a perforated support member 70 assembly can also be employed. The string of lights comprises opposite ends having an electrical connector and a receptacle. The string of lights may also be formed to have either both electrical connectors 90 or both receptacles 88. After several support members 30 and perforated members 38 or perforated support members 70 are matched with the string of lights, coupling wires would be used to connect two sets of support/perforated member combinations and lights. FIG. 7 shows the string of lights 48 and perforated member and support member 30 placed around a door 90 for decorating purposes.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

I claim:

1. A lighting assembly comprising:

a string of lights having light bulbs held in a socket, said light bulbs comprising a bulb portion and a socket portion, said socket portion being mated with said socket;

a first member comprising a plurality of perforations, an inside surface and an outside surface, wherein said perforations are adapted to receive and resiliently retain at least one bulb portion of said light bulbs on said string of lights, wherein said bulb portion of said lights are inserted into said perforations from said inside surface toward said outside surface such that said bulb portion extends through said perforation proximate said outside surface; and a support member adapted to mate with the first member so as to substantially cover said inside surface of said first member such that said first member retains said string of lights within said second support member.

2. The assembly of claim 1 wherein said support member and perforated member can be cut to vary their respective lengths.

3. The assembly of claim 1 further comprising:

a plurality of string of lights having light bulbs held within sockets.

4. The assembly in claim 1 wherein said support member and perforated member are removably coupled together such that the perforated member may move from a first position to enable a string of lights to be positioned within respective holes and to a second position such that the light bulbs are placed and securely maintained in an operating position between said perforated member and support member.

5. The assembly in claim 1, wherein said support member further defines a channel for receiving a string of lights.

6. The assembly of claim 1 wherein each of said support members is made of a PVC material.

7. The assembly in claim 1 wherein said perforated member and support member are removably coupled to each other.

8. The assembly in claim 7 wherein said perforated member and support member are removably coupled together with at least one tether.

9. The assembly in claim 1 wherein said perforated member is formed with at least one slot and said support member is formed with a latch member adapted to removably engage the slot to couple the perforated member and support member together.

10. The assembly in claim 1 wherein said support member is formed with at least one slot and said perforated member is formed with a latch member adapted to removably engage the slot to couple the perforated member and support member together.

11. A light assembly made by a method comprising the steps of:

providing a string of lights having light bulbs held in sockets, said light bulbs comprising a bulb portion and a socket portion, said socket portion being mated with said socket, such that said string of lights is matingly received within said support member;

providing a first member, said first member comprising a plurality of perforations, an inside surface and an outside surface, wherein said perforations are adapted to receive and resiliently retain at least one bulb portion of said light bulbs;

inserting said light bulbs on said sting of lights into said perforations from said inside surface toward said outside surface such that said bulb portion extends through said perforation proximate said outside surface; and providing a support member to matingly receive said first member such that said string of lights is retained within said first member and said support member.

12. The light assembly of claim 11 wherein said first member and said support member are made of a plastic material.

13. The light assembly of claim 12 wherein said plastic material is PVC.

14. The light assembly of claim 11 wherein said first member and said support member are removably coupled to each other.

15. The light assembly of claim 14 wherein said first member and said support member are removably coupled together with at least one tether.

16. The light assembly of claim 11 wherein said first member is formed with at least one slot and said support member is formed with a latch member adapted to removably engage the slot to couple the first member and support member together.

17. The light assembly of claim 11 wherein said support member is formed with at least one slot and said first member is formed with a latch member adapted to removably engage the slot to couple the perforated member and support member together.

* * * * *